US006987245B2

(12) United States Patent
Sanpei et al.

(10) Patent No.: US 6,987,245 B2
(45) Date of Patent: Jan. 17, 2006

(54) HEAT PLATE, HEATING ELEMENT, BELT TYPE FIXING DEVICE AND IMAGE FORMING APPARATUS

(75) Inventors: Koichi Sanpei, Kawasaki (JP); Mitsuhiro Mori, Kawasaki (JP); Akio Yano, Kawasaki (JP); Masatoshi Kimura, Kawasaki (JP); Masao Konishi, Kawasaki (JP); Takao Kawamura, Sakai (JP); Akio Harada, Osaka (JP); Tsuyoshi Nishi, Osaka (JP); Yukio Yamamoto, Osaka (JP); Yoshiaki Ohbayashi, Yao (JP); Naoya Takehara, Yao (JP); Toru Imai, Yao (JP)

(73) Assignees: Takao Kawamura, Osaka (JP); Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/949,526

(22) Filed: Sep. 27, 2004

(65) Prior Publication Data

US 2005/0035106 A1 Feb. 17, 2005

Related U.S. Application Data

(62) Division of application No. 10/106,844, filed on Mar. 27, 2002, now Pat. No. 6,826,382.

(30) Foreign Application Priority Data

Oct. 1, 2001 (JP) ..... 2001-305085

(51) Int. Cl.
*H05B 1/00* (2006.01)

(52) U.S. Cl. ..... 219/216; 399/328

(58) Field of Classification Search ..... 219/216, 219/601, 618, 653, 654; 399/328–330
See application file for complete search history.

(56) References Cited

U.S. PATENT DOCUMENTS

| | | | | |
|---|---|---|---|---|
| 5,499,087 | A * | 3/1996 | Hiraoka et al. | 399/329 |
| 6,289,198 | B1 | 9/2001 | Kawamura et al. | |
| 6,470,167 | B2 | 10/2002 | Hwang | |
| 6,636,718 | B2 | 10/2003 | Yura et al. | |
| 6,826,382 | B2 * | 11/2004 | Sanpei et al. | 399/328 |

* cited by examiner

*Primary Examiner*—Tu Ba Hoang

*Assistant Examiner*—Vinod Patel
(74) *Attorney, Agent, or Firm*—Westerman, Hattori, Daniels & Adrian LLP

(57) ABSTRACT

A heat plate for fixation comprising: a metallic base plate; and a heating resistor arranged on a reverse face of the metallic base plate, the heating resistor being formed by laminating, at least, an electric insulating layer and heating resistor layer in this order on the metallic base plate, wherein the heat plate is capable of raising the temperature of the metallic base plate to a fixing temperature when the heating resistor layer is energized and heated. A semicircular heating member for fixation comprises the heat plate which is curved so that the metallic base plate has a convex surface, a belt type fixing device is provided with the semicircular heating member, and an electrophotographic image forming apparatus is provided with the belt type fixing device comprising the semicircular heating member.

2 Claims, 8 Drawing Sheets

HEAT PLATE, HEATING ELEMENT, BELT TYPE FIXING DEVICE AND IMAGE FORMING APPARATUS

RELATED APPLICATION

This application is a divisional of U.S. patent application Ser. No. 10/106,844 filed on Mar. 27, 2002 now U.S. Pat. No. 6,826,382, which is hereby incorporated by reference in its entirety.

BACKGROUND OF THE INVENTION

1. Field of the Invention

The present invention relates to a fixing technology, more particularly, a heat plate and semicircular heating or heat-generating element which are effectively used for fixing a toner image. Also, the present invention relates to a belt type fixing device. Especially, the present invention relates to a heat plate for fixation having high reliability and durability and capable of increasing a temperature at a high rate, used for fixing a toner image in an image forming apparatus such as a copier, printer and so forth, which is based on an electrophotographic system; a heat plate for fixing a toner image having a temperature control property, the heat plate being of a temperature control type by which an upper limit of the temperature provided by a heating resistor layer can be set and controlled; a heat plate for fixing a toner image, the heat plate being of a self-temperature-control type by which a predetermined temperature distribution can be automatically set and controlled in a moment; a heat plate for fixing a toner image, the heat plate being of a complete self-temperature-control type having all the above functions; a semicircular heating member for fixing a toner image, the semicircular heating member being formed into a semicircle and curved by means of press forming; and a belt type fixing device into which the above components are incorporated, the belt type fixing device characterized in that energy can be saved and heating can be quickly conducted. Also, the present invention relates to various image forming apparatuses provided with the belt type fixing device of the present invention.

2. Description of the Related Art

In the electrophotographic system, which is widely used in copiers, printers and printing machines, generally positive or negative uniform electrostatic charges are applied onto a surface of a photoconductive insulator such as a photoreceptor drum. After the completion of this uniform electric charging step, when the photoconductive insulator is irradiated with a light image by various means, the electrostatic charges on the insulator are partially erased so that an electrostatic latent image can be formed. For example, when the photoconductive insulator is irradiated with a laser beams, surface electric charges in a specific portion can be erased. Due to the foregoing, an electrostatic latent image corresponding to image information can be formed on the photoconductive insulator. Next, fine powders of a developing agent, which is called a toner, are attached to the latent image portion on the photoconductive insulator in which electrostatic charges still remain. In this way, the latent image can be visualized. Finally, in order to obtain a print from the thus obtained toner image, the toner image is electrostatically transferred onto a recording medium such as recording paper. Finally, the thus transferred toner image is fused and fixed by applying heat, light or pressure.

As is well known, the fixing process for fixing a toner image, which is a final process of the electrophotographic system, is executed by using various fixing devices. At present, the following two types of fixing devices are commonly used. One is a flash fixing device for fusing and fixing toner by irradiating light such as a flash of light, and the other is a heat roller fixing device for fusing and fixing toner while applying pressure to toner by a heated fixing roller which is also referred to as a heat roller.

In general, in the heat roller fixing device, a heat roller and pressure roller are arranged opposed to each other, and a recording paper having a toner image transferred thereon is made to pass between a pair of rollers. The toner image is thermally fused and fixed onto the recording paper when the toner image is heated and pressurized at the same time. The practically used prior art heat roller comprises a light emitting heating tube such as a halogen lamp housed in a metallic pipe made of aluminum or stainless steel. FIG. 1 is a cross-sectional view showing a heat roller type fixing device composed as described above. The fixing device is provided with a heat roller 61 capable of rotating in the direction of arrow "a" and a pressure roller 62 capable of rotating in the direction of arrow "b". In the heat roller 61, there is provided a halogen lamp 63. On the other hand, a sheet of recording paper 38, onto the surface of which the toner image 51 has already been transferred in the previous process, is conveyed in the direction of arrow "c" and is inserted into a nip formed between the heat roller 61 and the pressure roller 62. Therefore, when the sheet of recording paper 38 passes through the nip between the heat roller 61 and the pressure roller 62, heat and pressure are simultaneously applied to the sheet of recording paper 38, so that the fused toner image can be fixed onto the surface of the sheet of recording paper 38.

However, the above heat roller utilizes radiation heat so as to heat the sheet of recording paper. Therefore, the following problems may be encountered. The heating efficiency is so low that it takes several minutes to several tens of minutes to heat the sheet of recording paper to a predetermined temperature necessary for thermal fixing, for example, it takes several minutes to several tens of minutes to heat the sheet of recording paper to 160° C. Especially, when a copier, which is in a stopped state out of operation, is turned on, it takes time to start the copier and an operator must wait for a long period of time, which lowers the working efficiency.

Recently, a copier or printer has been linked with another electronic device such as a personal computer. Therefore, if an input signal is transmitted to the personal computer during the waiting time, the system does not proceed at once, because it takes time to raise the heat roller temperature. As a result, the processing rate of the entire system is decreased. That is, no matter how the processing rate of the electronic device may be increased, it is difficult to increase the processing rate of the entire system unless drastic measures are taken for increasing the rate of heating the toner fixing section. In order to solve the above problems, it is conventional that the heat roller is energized and heated even while the entire system is waiting for a successive operation. In this connection, about one hundred million electrophotographic devices are operated all over the world. Therefore, when consideration is given to the fact that all of the electrophotographic devices are energized while they are waiting for a successive operation, it is necessary to take countermeasures for saving energy which is consumed in energizing the heat rollers during the waiting time.

As one countermeasure for saving energy, concerning the heating system for heating the fixing device, instead of the halogen lamp system which is used at present, a direct heating system, induction heating system and others have been developed. Concerning the heating efficiency, when the heating efficiency of the direct heating system is 1, the heating efficiency of the induction heating system is 0.8, and the heating efficiency of the halogen lamp heating system is 0.6. According to a revision of the Law of Saving Energy of April in 1999, competition for saving energy has grown more intense while targeting the conformity to Mode Restriction issued by the Ministry of Trade and Industry in 2000 and also targeting the conformity to the Law of Top Runner in 2006. Equipment to satisfy the above laws on saving energy has already been coming into the market while they use their own techniques to save energy. Digital technique has been widely adopted and color images are processed by every image processing device, and further two or more devices are combined with each other so as to enhance the performance. In order to meet demand for increasing the processing rate, enhancing the image quality and saving energy, belt type fixing devices tend to be adopted.

For example, as shown in FIG. 2, the belt type fixing device includes: a fixing roller (having no heat source therein) 61 capable of rotating in the direction of arrow "a"; a heating unit 65; an endless belt 66 provided between the fixing roller 61 and the heating unit 65; and a pressure roller 62 capable of rotating in the direction of arrow "b", the pressure roller 62 coming into pressure contact with the fixing roller 61 via the belt 66. The heating unit 65 is formed into a roller arranged in parallel with the fixing roller 61. The heating unit 65 is composed of a cylindrical heat conductive roller 67 and a heating sheet 68 bonded inside the heat conductive roller 67. The heating sheet 68 includes a heating resistor capable of heating when an electric current flows into it. Heat generated in the heating sheet 68 is transmitted to the belt 66 via the heat conductive roller 67 surrounding the heating sheet 68. On the other hand, a sheet of recording paper 38, on the surface of which a toner image 51 is formed in the previous process, is conveyed in the direction of arrow "c" and inserted into the nip formed between the belt 66, which is guided on a surface of the fixing roller 61, and the pressure roller 62. Due to the foregoing, when the sheet of recording paper 38 passes through the nip formed between the rollers, heat and pressure are simultaneously applied to the sheet of recording paper 38. Therefore, the fused toner image can be fixed onto the surface of the sheet of recording paper 38.

When importance is attached to improvement of energy saving properties, the most important matter is how to reduce heat radiation from the endless belt for fixing, the fixing roller and the pressure roller. In order to save energy and reduce the temperature rising time and further in order to reduce the manufacturing cost of the device, the most important issue is how to reduce the heat capacity and the size of the device.

Recently, copiers have made rapid progress as follows. Recent copiers are provided not only with a simple function but also a multiple function, that is, the copiers are composed into compound machines having multiple functions of copying, printing and communicating (function of a facsimile device). Further, the copiers can process not only a monochrome image but also a full color image. In these copiers, various sheets of recording paper, the sizes of which are A5, B5, A4, B4 and A3, are used. When sheets of recording paper of small sizes such as A5 or B5 are frequently used, the surface temperature of a sheet threading portion of the heating member in the sheet threading section is decreased. In contrast, the surface temperature of a portion of the heating member in which the sheet of paper does not thread is increased. Therefore, there is a great difference in the surface temperature distribution. In the case of a conventional fixing device in which a halogen lamp is used, this difference in the surface temperature of the sheet threading portion and that of the portion in which the sheet does not thread is so great that a temperature boundary appears on the sheet of recording paper. Especially in the case of equipment in which processing is conducted at a high processing rate, for example, in the case of a color image forming apparatus, this phenomenon is remarkably caused, and the difference in the surface temperature distribution appears directly on a sheet of recording paper.

In the case of forming a monochrome image, no problems are caused. However, in the case of a fixing device used for forming a color image, there is a demand of having both the thermal fixing function and the full coloring function. In order to meet this demand, it is necessary to raise the temperature to 160° C., which is the fixing temperature, in a temperature raising time of not more than 10 seconds, and it is also necessary for the surface temperature distribution of the heating member to be uniform in a range of fluctuation of ±5% while maintaining a high degree of energy saving. In the age of digital technology, various targets of developing the fixing device are set such as a reduction in electric power consumption, shortening of the temperature rising time and a technique for automatically controlling the surface temperature distribution. Especially in the case of equipment in which color images are processed, in order to obtain images of high quality, it is necessary to quickly raise the temperature and for the distribution of surface temperature to be uniform.

SUMMARY OF THE INVENTION

The present inventors have devised a direct heating system in which heating is directly conducted by energizing a heating resistor layer instead of a heating system in which heating is conducted by a light emitting heating tube such as a halogen lamp and others. That is, a heating resistor layer is formed on the inner circumferential face or the outer circumferential face of a metallic material tube via an electric insulating layer. When this heating resistor layer is energized and heated, the metallic material tube can be quickly heated. A fixing roller having this heating function capable of quick heating can be referred to as a quick heat roller (QHR). The present inventors conducted investigations into the performance of this quick heat roller, and as a result, it was found and proved that the quick heat roller can heat several times quicker than a halogen lamp system. Accordingly, it is possible to apply this quick heat roller to the fixing device of an electrophotographic apparatus such as a copier, printer and so forth.

Although the temperature raising performance of the quick heat roller is high, problems to be solved still remain in the method of forming the quick heat roller. Also, problems to be solved still remain in the field of reliability and durability.

For example, in the case of forming the heating resistor layer on the outer circumferential face of a metallic material tube, the forming method is relatively simple. Layers of various materials may be formed on the outer circumferential face by a spraying or dipping method. However, in this case, there are problems in the durability of the heating resistor layer. In the course of operation, the outer circumferential face of the quick heat roller repeatedly comes into contact with a recording paper, a thermistor for detecting temperatures and a toner separating pawl. Due to the above mechanical contact, each layer formed on the heating member is always worn out. Therefore, the life of the quick heat roller is impaired. When abrasion extends to the heating resistor layer, there is a possibility of electric leakage and burning out.

In the case of forming the heating resistor layer on the inner circumferential face of the metallic material tube, the heating resistor layer does not come into contact with a recording paper. Therefore, it is possible to ensure long life of the quick heat roller. However, it is very difficult to uniformly form the heating resistor layer on the inner circumferential face of the metallic material tube. Accordingly, the present inventors have devised a method in which each layer is formed on an insulating sheet so as to make a heating resistor sheet first and then the thus made heating resistor sheet is bonded on the inner circumferential face of the metallic material tube. However, according to the above method, it is not easy to ensure satisfactory mass production characteristics while uniformity of bonding, mechanical strength and reliability are being guaranteed.

Accordingly, the first object of the present invention is to provide a heat plate for fixation utilizing a heating resistor capable of being easily formed, the reliability of which can be guaranteed and the heating efficiency of which is high, and characterized in that the temperature can be quickly raised, energy can be saved, and the manufacturing cost can be reduced.

The second object of the present invention is to provide a heating member for fixation, the upper limit of temperature obtained by the heating resistor of which is automatically set so as to prevent the heating member from being overheated and burned out, and characterized in that the durability and reliability are high.

The third object of the present invention is to provide a multifunctional heating member of the self-temperature-control type or the complete self-temperature-control type capable of automatically controlling the surface temperature distribution of the heating member to a predetermined temperature.

The fourth object of the present invention is to provide a very small and multifunctional belt type fixing device using the above heating member, the manufacturing cost of which is low, capable of heating at a high heating rate and capable of greatly saving energy.

The fifth object of the present invention is to provide a compact and high-performance image forming apparatus in which the belt type fixing device of the present invention is used. Especially, the fifth object of the present invention is to provide an image forming apparatus based on an electrophotographic system.

These objects and other objects of the present invention will become more apparent in the following detailed descriptions.

In one aspect of the present invention, there is provided a heat plate for fixation comprising: a metallic base plate; and a heating resistor arranged on a reverse face of the metallic base plate, the heating resistor being formed by sequentially laminating, at least, an electric insulating layer and heating resistor layer in this order on the metallic base plate, wherein the heat plate is capable of raising the temperature of the metallic base plate to a fixing temperature when the heating resistor layer is energized and heated.

The heat plate for fixation of the present invention can be advantageously executed in various embodiments.

For example, it is preferable that the heating resistor layer of the heat plate be made of a mixture having added thereto a synthetic resin or glass capable of forming a matrix with Mo or Ag as a metallic resistor material.

It is also preferable that the electric insulating layer of the heat plate be a heat transmission strengthening layer consisting of an electric insulating material having a high coefficient of thermal conductivity, and when the heating resistor layer is energized and heated via the heat transmission strengthening layer, the generated heat is effectively conducted onto the metallic base plate.

Further, it is preferable that the heating resistor of the heat plate comprise a laminar heating resistor which is composed of a heat transmission strengthening layer, heating resistor layer, heat insulation strengthening layer, heat reflecting layer for reflecting heat rays onto the metallic base plate side and a protective layer laminated in this order on the metallic base plate.

Furthermore, it is preferable that the metallic base plate of the heat plate be composed of one of an aluminum plate, stainless steel plate, common steel plate and galvanized sheet iron, and a reverse side of the metallic base plate, in contact with the heating resistor layer has a roughened surface.

Furthermore, it is preferable that the film thickness of the heating resistor layer of the heat plate in the portion of the lead-in terminal side be smaller than that in the central portion of the heating resistor layer, so that heating electric power on the lead-in terminal side is higher than that of the central portion, and thus the surface temperature distribution of the metallic base plate becomes uniform.

Furthermore, it is preferable that each layer composing the heating resistor of the heat plate be formed by the screen printing method, and the film thickness of each layer be controlled by applying multiple layer printing, and after the layers have been formed, the resulting layered structure heated and pressurized in order to make the film of each layer tight and stabilize the resistance of each layer, and further subjected to the energizing and heating treatment for aging so as to greatly enhance the reliability and durability of each layer.

In another aspect of the present invention, there is provided a temperature controlling type heat plate for fixation comprising: a metallic base plate; and a heating resistor arranged on a reverse face of the metallic base plate, the heating resistor being formed by sequentially laminating, at least a heat transmission strengthening layer, heating resistor layer for controlling temperature, heat transmission strengthening layer, heating resistor layer, heat insulation strengthening layer, heat reflecting layer and protective layer in this order on the metallic base plate, wherein the heating resistor layer for controlling temperature is made of a resistor material having a positive temperature coefficient, and when the heating resistor is energized and heated, the temperature of the heating resistor is automatically set and controlled so that the temperature is not increased to not less than 300° C.

In this heat plate, it is preferable that the temperature controlling type heating resistor layer having a positive temperature coefficient be made of ultra fine powders of Mo or Ag as a primary resistor material, and at least one of the single metals of Ge, Si, Sn and Zn, SnZn alloy, or $Y_3FeO_{12}$, as an auxiliary resistor material.

Further, in another aspect of the present invention, there is provided a self-temperature-controlling type heat plate for fixation comprising: a metallic base plate; and a heating resistor arranged on a reverse face of the metallic base plate, the heating resistor being formed by sequentially laminating, at least, a heat transmission strengthening layer, heating resistor layer for controlling temperature, heat transmission strengthening layer, heating resistor layer, heat insulation strengthening layer, heat reflecting layer and protective layer in this order on the metallic base plate, wherein the heating resistor layer for controlling temperature is made of a resistor material having a negative temperature coefficient, and when the heating resistor layer is energized and heated by a constant current power source, a low temperature section is heated by high electric power because of its high resistance, and a high temperature section is heated by low electric power because of its low resistance, so that a surface temperature obtained by the heating resistor layer is compensated by the thus generated heat and a local temperature distribution of the heat plate can be automatically controlled in a moment to be uniform.

In this heat plate, it is preferable that the temperature controlling type heating resistor layer having a negative temperature coefficient be made of as a primary resistor material, ultra fine powders of Mo or Ag and as an auxiliary resistor material, a semiconductor material comprising a metal of Group III or V on the Periodic Table added to a metal of Group IV, or powders of lower oxide of transition metal.

Further, in still another aspect of the present invention, there is provided a complete self-temperature-controlling type heat plate for fixation comprising: a metallic base plate; and a heating resistor arranged on a reverse face of the metallic base plate, the heating resistor being formed by sequentially laminating, at least, a heat transmission strengthening layer and a second temperature controlling type heating resistor layer on a set of a heat transmission strengthening layer and a first temperature controlling heating resistor layer, and further laminating thereon a heat insulation strengthening layer, heat reflecting layer and protective layer in this order.

In this heat plate, it is preferable that the second temperature controlling heating resistor layer have a positive temperature coefficient and its temperature is controlled by a common electric power source, and the first temperature controlling heating resistor layer have a negative temperature coefficient and its temperature controlled by a constant current electric power source.

In addition to the above-described heat plates for fixation, the present invention provides a semicircular heating member for fixation in which the above heat plate is curved so that the metallic base plate has a convex surface. Although no description is included here, in order to avoid duplication, the heat plate used for the heating member of the present invention includes various embodiments as described above, and will be explained in detail below.

Further, the present invention provides a multifunction fixing roller-circumscribing belt type fixing device comprising a pressure roller arranged inside a semicircular heating member for fixation, an endless belt for fixation wound round an outer circumference of the semicircular heating member, and a fixing roller arranged on a face of the endless belt opposing to the pressure roller, in which the endless belt is heated to a predetermined temperature, and while a load is acting between the pressure roller and the fixing roller, a recording sheet preliminarily heated by a heat plate for preliminarily heating is passed between the pressure roller and the fixing roller, thereby thermally fixing a toner image on the recording sheet, and the semicircular heating member is one member selected from the group consisting of:

(1) a semicircular heating member for fixation which comprises a heat plate for fixation comprising: a metallic base plate; and a heating resistor arranged on a reverse face of the metallic base plate, the heating resistor being formed by sequentially laminating, at least, an electric insulating layer and heating resistor layer in this order on the metallic base plate, wherein the heat plate is capable of raising the temperature of the metallic base plate to a fixing temperature when the heating resistor layer is energized and heated, and the heat plate is curved so that the metallic base plate has a convex surface, (2) a semicircular heating member for fixation which comprises a temperature controlling type heat plate comprising: a metallic base plate; and a heating resistor arranged on a reverse face of the metallic base plate, the heating resistor being formed by sequentially laminating, at least, a heat transmission strengthening layer, heating resistor layer for controlling temperature, heat transmission strengthening layer, heating resistor layer, heat insulation strengthening layer, heat reflecting layer and protective layer in this order on the metallic base plate, wherein the heating resistor layer for controlling temperature is made of a resistor material having a positive temperature coefficient, and when the heating resistor is energized and heated, the temperature of the heating resistor is automatically set and controlled so that the temperature is not increased to 300° C. or more, and the heat plate is curved so that the metallic base plate has a convex surface, (3) a semicircular heating member for fixation which comprises a self-temperature-controlling type heat plate comprising: a metallic base plate; and a heating resistor arranged on a reverse face of the metallic base plate, the heating resistor being formed by sequentially laminating, at least, a heat transmission strengthening layer, heating resistor layer for controlling temperature, heat transmission strengthening layer, heating resistor layer, heat insulation strengthening layer, heat reflecting layer and protective layer in this order on the metallic base plate, wherein the heating resistor layer for controlling temperature is made of a resistor material having a negative temperature coefficient, and when the heating resistor layer is energized and heated by a constant current power source, a low temperature section is heated by high electric power because of its high resistance, and a high temperature section is heated by low electric power because of its low resistance, so that a surface temperature obtained by the heating resistor layer is compensated by the thus generated heat and a local temperature distribution of the heat plate can be automatically controlled in a moment to be uniform, and the heat plate is curved so that the metallic base plate has a convex surface, and (4) a semicircular heating member for fixation which comprises a complete self-temperature-controlling type heat plate comprising: a metallic base plate; and a heating resistor arranged on a reverse face of the metallic base plate, the heating resistor being formed by sequentially laminating, at least, a heat transmission strengthening layer and a second temperature controlling type heating resistor layer on a set of a heat transmission strengthening layer and a first temperature controlling heating resistor layer, and further laminating thereon a heat insulation strengthening layer, heat reflecting layer and protective layer in this order, and the heat plate is curved so that the metallic base plate has a convex surface.

Furthermore, the present invention provides a multifunction fixing roller-inscribing belt type fixing device comprising a fixing roller arranged inside a semicircular heating member for fixation, an endless belt for fixation wound round an outer circumference of the semicircular heating member, and a pressure roller arranged on a face of the endless belt opposing to the fixing roller, in which the endless belt is heated to a predetermined temperature, and while a load is given between the fixing roller and the pressure roller, a recording sheet preliminarily heated by a heat plate for preliminarily heating is passed between the fixing roller and the pressure roller, thereby thermally fixing a toner image on the recording sheet, and the semiconductor heating member is one member selected from the group consisting of the heating members (1) to (4) of the present invention described above.

Furthermore, the present invention provides an electrophotographic image forming apparatus comprising: an electrostatic latent image forming section for forming an electrostatic latent image by image exposure; a developing section for developing the electrostatic latent image with a developing agent comprising a toner to visualize the electrostatic latent image; an image transfer section for transferring the visualized toner image to a recording medium; and an image fixing section for fixing the transferred toner image to the recording medium, in which the image fixing section comprises a multifunction fixing roller-circumscribing belt type fixing device comprising a pressure roller arranged inside a semicircular heating member for fixation, an endless belt for fixation wound round an outer circumference of the semicircular heating member, and a fixing roller arranged on a face of the endless belt opposing to the pressure roller, in which the endless belt is heated to a predetermined temperature, and while a load is acting between the pressure roller and the fixing roller, the recording medium preliminarily heated by a heat plate for preliminarily heating is passed between the pressure roller and the fixing roller, thereby thermally fixing the toner image on the recording medium, and the semicircular heating member is one member selected from the group consisting of the heating members (1) to (4) of the present invention described above.

Moreover, the present invention provides an electrophotographic image forming apparatus comprising: an electrostatic latent image forming section for forming an electrostatic latent image by image exposure; a developing section for developing the electrostatic latent image with a developing agent comprising a toner to visualize the electrostatic latent image; an image transfer section for transferring the visualized toner image to a recording medium; and an image fixing section for fixing the transferred toner image to the recording medium, in which the image fixing section comprises a multifunction fixing roller-inscribing belt type fixing device comprising a fixing roller arranged inside a semicircular heating member for fixation, an endless belt for fixation wound round an outer circumference of the semicircular heating member, and a pressure roller arranged on a face of the endless belt opposing the pressure roller, in which the endless belt is heated to a predetermined temperature, and while a load is acting between the fixing roller and the pressure roller, the recording medium preliminarily heated by a heat plate for preliminarily heating is passed between the pressure roller and the fixing roller, thereby thermally fixing the toner image on the recording medium, and the semicircular heating member is one member selected from the group consisting of the heat members (1) to (4) of the present invention described above.

DESCRIPTION OF THE PREFERRED EMBODIMENTS

Figure 1:
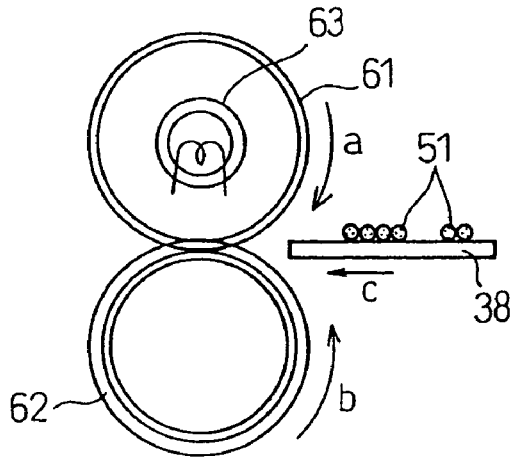
Fig. 1 PRIOR ART
FIG. 1 is a cross-sectional view showing an example of the prior art heat roller type fixing device.
Figure 2:
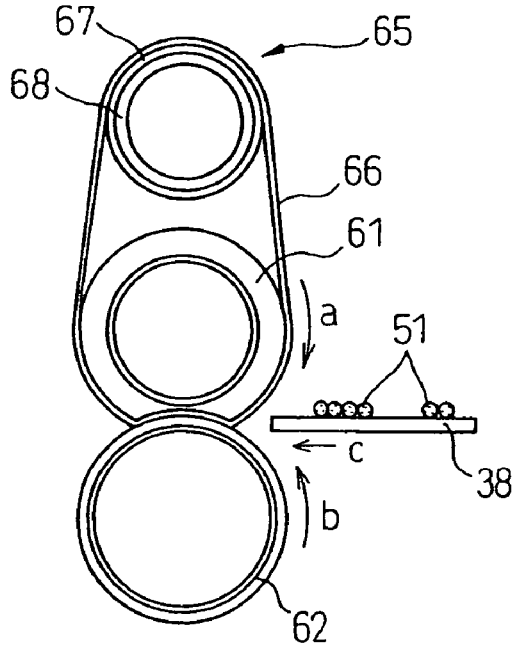
Fig. 2 PRIOR ART
FIG. 2 is a cross-sectional view showing another example of the prior art belt type fixing device.
Figure 3:
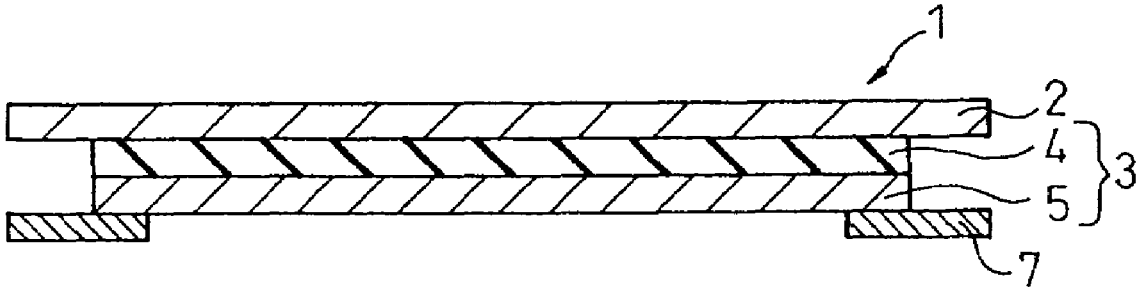
FIG. 3 is a cross-sectional view showing a principle structure of the heat plate for fixation used for the belt type fixing device of the present invention.

FIG. 3 is a sectional view showing a principal structure of a heat plate for fixation used in the belt type fixing device of the present invention. As shown in the drawing, the heat plate 1 includes: a metallic base plate 2; and a heating resistor 3 attached on the reverse side of the metallic base plate 2. The heating resistor 3 includes at least: an electric insulating layer 4; and a heating resistor layer 5, wherein the electric insulating layer 4 and the heating resistor layer 5 are laminated on the metallic base plate 2 in this order. The heating resistor layer 5 is made of either low temperature burning type heating resistor material, temperature control type heating resistor material, the temperature coefficient of which is positive, or temperature control type heating resistor material, the temperature coefficient of which is negative. When the heating resistor layer 5 is energized and heated through the lead-in terminal 7, the metallic base plate 2 can be heated to a fixing temperature.

Although the detail is described below, when the heat plate for fixation is composed as described above, the heat plate, on the reverse face of the metallic base plate of which the heating resistor layer is laminated, can be easily manufactured. Further, the semicircular heating member can be mass-produced at low cost by using different pastes of low temperature burning type heating resistor. When the heat plate is composed of a multiple layer structure, the generated heat can be effectively used for the heating member, so that the temperature rising characteristic can be further improved.

According to the present invention, the heat generated from the heating resistor can be effectively transmitted to the metallic base plate by the heat transmission strengthening layer, the electric insulating property is high, and the temperature can be raised at a higher rate.

In this connection, the heat plate 1 of the present invention is not limited to the specific embodiment shown in FIG. 3. Variations and modifications may be made without departing from the scope of the present invention.

Figure 4A:
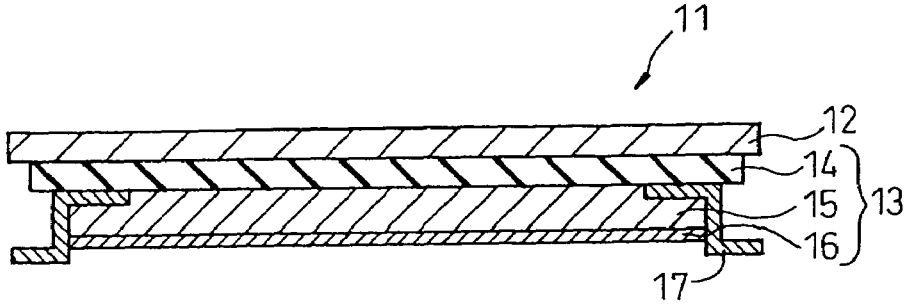
FIG. 4A is a cross-sectional view showing the heat plate for fixation according to the first embodiment of the present invention.
Figure 7:
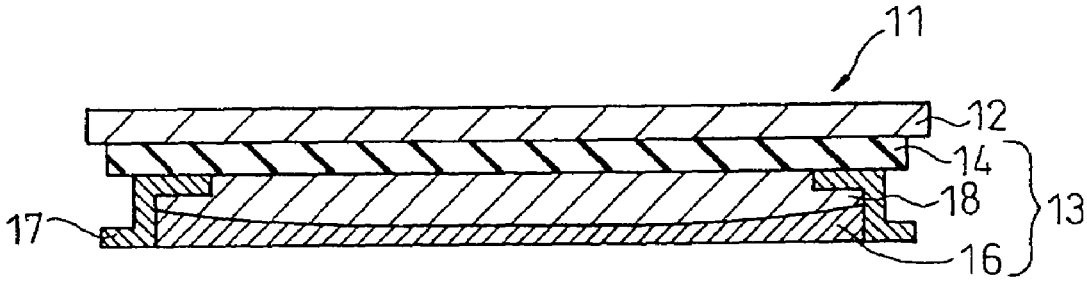
FIG. 7 is a cross-sectional view showing the heat plate for fixation according to the second embodiment of the present invention.

For example, as shown in FIGS. 4A and 7, in the heat plate 11 for fixation, the electric insulating layer 4 may be composed as the heat transmission strengthening layer 14 made of electric insulating material, the heat conductivity of which is high. The generated heat can be effectively conducted to a side of the metallic base plate 2 via the heat transmission strengthening layer 14.

Figure 8:
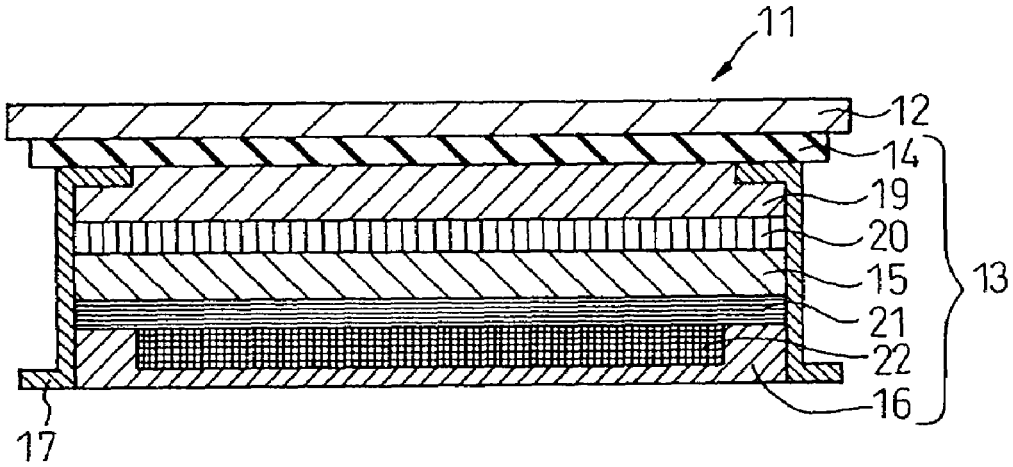
FIG. 8 is a cross-sectional view showing the heat plate for fixation according to the third embodiment of the present invention.

For example, as shown in FIG. 8, in the heat plate 11 for fixation, the heating resistor 3 may be composed as the heating resistor 13 in which the heat transmission strengthening layer 14, heating resistor layer 15, heat insulation strengthening layer 21, heat reflecting layer 22 and protective layer 16 are laminated on the metallic base plate 12 in this order. Due to the above structure, it is possible to prevent the heat which has been generated by the heating resistor layer 15 from scattering or dispersion loss. Further, the generated heat can be reflected by the heat reflecting layer 22 to a side of the metallic base plate 12, so that the temperature rising time can be greatly shortened.

Further, in these and other heat plates, when the metallic base plate is composed of one of an aluminum plate, stainless steel plate, common steel plate (including galvanized sheet iron) and the like, and a reverse side of the metallic base plate, which comes into contact with the heating resistor layer, is roughened, the metallic base plate can be more strongly adhered to the heating resistor layer. Especially, it is possible to use inexpensive metallic material, the heat conductivity of which is high, for the base plate. Therefore, it is possible to mass-produce inexpensive heat plates and heat generating members.

Figure 9:
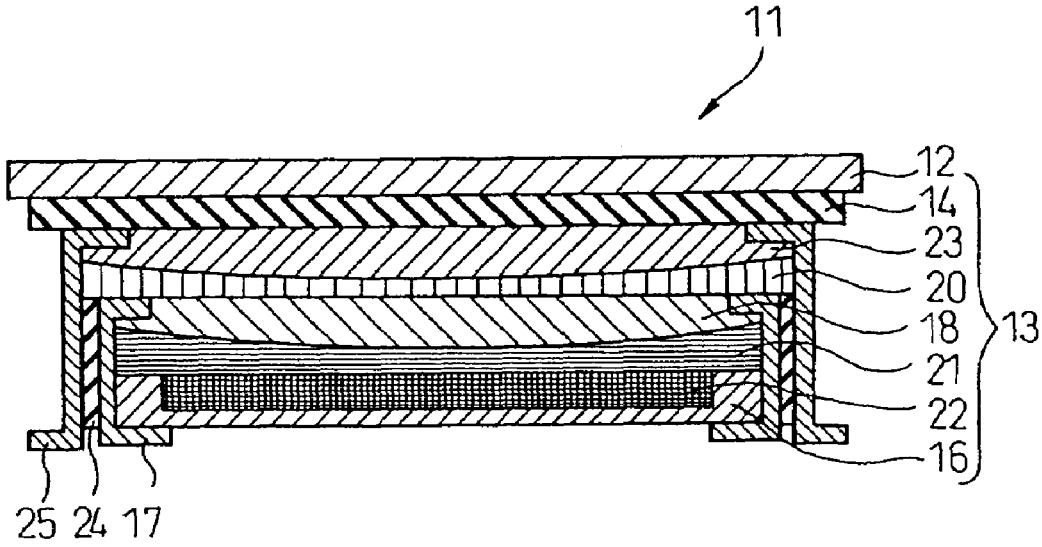
FIG. 9 is a cross-sectional view showing the heat plate for fixation according to the fourth embodiment of the present invention.
Figure 10:
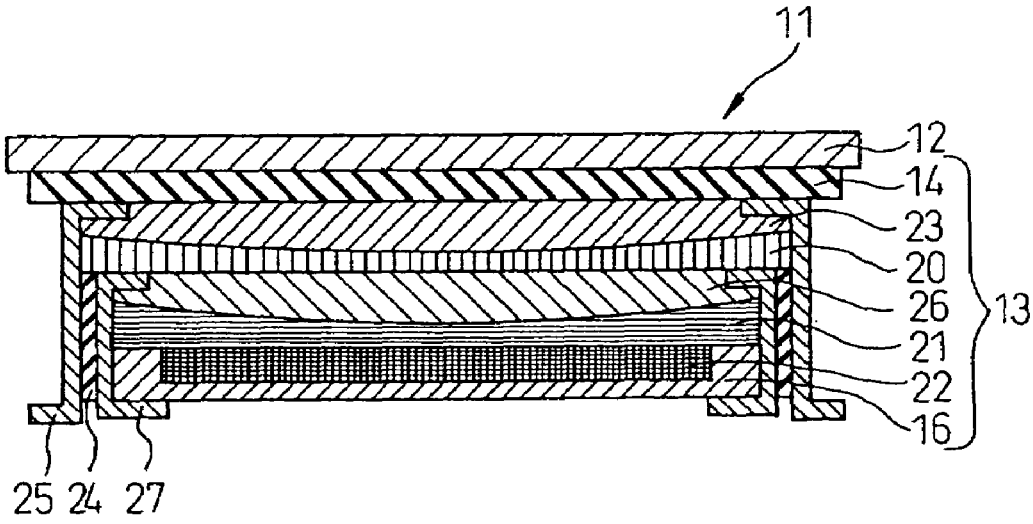
FIG. 10 is a cross-sectional view showing the heat plate for fixation according to the fifth embodiment of the present invention.

Furthermore, in the heating resistor layer, for example, when the film thickness of the heating resistor layer on the lead-in terminal side is made less than the thickness of the central portion and the heating electric power on the lead-in terminal side is set higher than the heating electric power in the central portion as shown in FIGS. 7, 9 and 10, it is possible to compensate for a decrease in temperature caused by the emission of heat according to the conduction of heat in the lead-in terminal section. In this way, the surface temperature distribution of the heating member can be made uniform.

In the case of forming the heating resistor, when the heating resistor is formed into a layer by the screen printing method and each layer composing the heating resistor is formed by the method of multiple printing, each layer can be easily formed and laminated, and further the thickness of each layer can be easily and appropriately controlled. When the heating resistor is heated and pressurized after the completion of forming a layer, the layer property can be made dense and the resistance can be stabilized. Furthermore, when the heating resistor is subjected to energizing treatment for aging, the reliability and durability of the heating resistor can be enhanced.

When the heating resistor is composed as a temperature control type heating resistor layer, the positive temperature coefficient of which is high, even if the temperature control circuit is damaged, the temperature of the heating resistor can be automatically controlled so that the heating resistor cannot be heated higher than 300° C. and the recording sheet is not burned. In other words, it is possible to provide a temperature control type heat plate 11 for fixation.

Further, for example, as shown in FIG. 9, in the heat plate 11 for fixation, the heating resistor 3 may be formed into the laminated heating resistor 13 which is composed in such a manner that the heat transmission strengthening layer 14, temperature control type heating resistor layer 23, heat transmission strengthening layer 20, heating resistor layer 18, heat insulation strengthening layer 21, heat reflecting layer 22 and protective layer 16 are laminated in this order on the metallic base plate 12. In this case, the temperature control type heating resistor layer 23 is made of resistor material, the temperature coefficient of which is negative, and energized and heated by a constant electric current power source, so that a difference in the temperature between the sheet threading section and the section in which the sheet has not threaded yet can be controlled in a moment, thereby enabling automatically control a local surface temperature distribution of the heating member so that the temperature distribution can be made uniform. In other words, it is possible to provide a self-temperature-control type heat plate 11 for fixation.

Furthermore, for example, as shown in FIG. 10, in the heat plate 11 for fixation, the heating resistor 3 may be formed into the laminated heating resistor 13 which is composed in such a manner that the heat transmission strengthening layer 14, temperature control type heating resistor layer 23 having a negative temperature coefficient, heat transmission strengthening layer 20, temperature control type heating resistor layer 26 having a positive temperature coefficient, heat insulation strengthening layer 21, heat reflecting layer 22 and protective layer 16 are laminated in this order on the metallic base plate 12. The temperature control type heating resistor layer 23 having a negative temperature coefficient is capable of taking a share in the work of making the surface temperature distribution of the heating member uniform. The temperature control type heating resistor layer 26 having a positive temperature coefficient is capable of taking a share of the work of controlling an upper limit of the rate of raising a temperature and also capable of taking a share of the work of controlling the maximum temperature. That is, when the above layer structure is adopted, it is possible to provide a multifunctional complete self-temperature-control type heat plate 11 for fixation, by which a local surface temperature distribution on the metallic base plate 12 can be completely self-controlled.

In this heat plate 11, when the positive temperature coefficient temperature control type heating resistor layer 26 is connected to a common electric power source and the negative temperature coefficient temperature control type heating resistor layer 23 is connected to a constant current electric power source, excellent temperature control is made possible by proper use of the electric power source.

The present inventors also carried out extensive investigations into the belt type fixing device in order to attain easy production, enhance the reliability, reduce the manufacturing cost and save energy. As a result of their investigations, the present inventors devised a very small and multifunctional belt type fixing device which is composed in such a manner that the heat plate for fixation of the present invention, on the reverse face of the metallic base plate of which the heating resistor is arranged, is formed into a semicircular heating member in which the metallic base plate is curved to have a convex surface, and this heat plate is housed in the belt type fixing device. Referring to FIGS. 4A to 6, the semicircular heating member and the belt type fixing device will be explained hereinbelow.

FIG. 4A is a longitudinal sectional view showing an outline of the heat plate for fixation according to the first embodiment of the present invention. On the reverse face of the metallic base plate 12, there is provided a heating resistor 13 which is composed of a heat transmission strengthening layer 14, heating resistor layer 15 and protective layer 16. At both end portions of the heating resistor layer 15, there are provided electrode layers which are represented by reference numeral 17 in the drawing. The lead-in terminals 17 are connected to the electrode layers. The lead-in terminals 17 are connected to an electric power source not shown in the drawing.

The metallic base plate 12 is a member for conducting heat to the endless belt for fixation described later. This metallic base plate 12 is composed of an aluminum plate, nickel plate, galvanized sheet iron and the like. A reverse side of the metallic base plate 12, which comes into contact with the heating resistor 13, is fabricated to have a roughened surface. Therefore, when the heating resistor 13 is laminated on the reverse side of the metallic base plate 12, the adhesion property and heat conductivity can be enhanced. The roughened surface reflects heat rays less than a smooth surface. Therefore, it is possible to enhance the temperature rising property of the metallic base plate 12.

When the heating resistor layer 15 is formed, not only the electric conductive material but also a mixture can be used, with which heat-resistant synthetic resin or glass, which forms a matrix with the electric conductive material, is mixed. Depending upon the object, other widely known materials may be added. The primary resistor material includes a single metal of Ag, Ni, Au, Pd, Mo, Mn or W. Alternatively, the primary resistor material includes an alloy of AgPd, CuNi, CuZn, CuSn or MoAg. Especially, fine powders of Mo or Ag are effectively used. Further, intermetallic compounds such as $Re_2O_3$, $Mn_2O_3$ and $LaMnO_3$ may be used. When glass, which forms a matrix with the electric conductive material, is used, a change in the resistance caused in the heating and cooling cycle can be reduced.

The heat transmission strengthening layer 14 not only functions as an electric insulating layer, but also as a positively conducting heat to the metallic base plate 12 side. In general, the heat conductivity of a high electric insulating substance is low. Therefore, when importance is attached to the electric insulating property and the film thickness of the insulating layer is increased, the heat conductivity is greatly reduced and the temperature rising property is seriously impaired. Accordingly, it is preferable that the heat conductivity and the electric insulating property of substance composing the heat transmission strengthening layer 14 be high. As an electric insulating substance, the heat conductivity of which is high, there are metallic oxides, among which high purity alumina ($Al_2O_3$) is a suitable material. Fine powders of the metallic oxide are mixed with a heat-resistant organic insulating substance to prepare a paste, and heated and hardened. Thus, the heat transmission strengthening layer 14 is formed.

Alternatively, the heat transmission strengthening layer 14 can be formed in such a manner that metallic powders are mixed with an electric insulating substance to prepare a paste, and heated and hardened. In general, the heat conductivity of metallic powder is high. Therefore, when metallic powders are mixed with an electric insulating substance, it is possible to maintain both heat conductivity and electric insulating property. However, metallic powder itself has electric conductivity. Therefore, in order to ensure the electric insulating property in this case, it is necessary to pay attention to the quantity of the electric insulating substance and also to the mixing property of the electric insulating substance. In order to further enhance the electric insulating property, an electric insulating layer may be laminated on the heat transmission layer to form a duplitized layer, and the thus formed duplitized layer may be used as the heat transmission strengthening layer 14.

The electric insulating substances are roughly classified into inorganic electric insulating material and organic electric insulating material. The inorganic electric insulating material includes oxide electric insulating material, mica, marble, ceramics and glass, and organic electric insulating material includes plastics, rubber, wax and compound which are well known materials. These electric insulating substances may be properly used according to their heat-resistance property, electric insulating property and processing performance. From the viewpoint of the heat-resistance property and electric insulating property, it is preferable to use polyimide heat-resistant resin.

The protective layer 16 is provided for protecting the heating resistor from moisture. When the heating resistor is protected by polyimide heat-resistant resin, it becomes a heat-resistant electric insulating layer. In the case where the heating member is made by press-forming the heat plate so that the heat plate can be curved, this protective layer 16 protects the heating resistor layer 15 from being damaged. When fluororesin is mixed in the protective layer, it becomes easy to peel off.

In order to form each layer described above, it is possible to use various film forming methods. Especially, the screen printing method can be advantageously used. For example, when the heating resistor layer 15 is formed from low temperature burning type heating resistor paste or when the heat transmission strengthening layer 14 is formed from electric insulating paste or when the heating resistor layer 15 is formed from electric insulating paste, the screen printing method is utilized, and the formation of each layer can be facilitated by controlling the layer thickness. According to the screen printing method, only when a desirable perforated pattern is interposed and a screen to be used is changed, is it possible to print an arbitrary pattern. When multiple layer printing such as double or triple layer printing is conducted in order to adjust the layer thickness, the resistance of the heating resistor layer 15 and the insulation of the heat transmission strengthening layer 14 can be arbitrarily controlled.

In the practice of the present invention, the method of forming each layer is not limited to the screen printing method. It is also possible to use a well-known method such as a spraying method, brushing method or dipping method. In the case where electric conductive layers or electric insulating layers are stuck, the layer itself can be used, and when the thickness of the layers used is changed or the number of the layers used is controlled, the resulting physical properties can be appropriately adjusted.

In the case where each layer is formed by a film formation, followed by lamination, various technical methods can be used. The following method is preferably used. First, one layer is printed by using low temperature burning type paste. Next, this layer is heated and temporarily dried. While printing and temporary drying are being repeated, each layer is successively laminated. Finally, when all the layers are heated and pressurized, they are thermally hardened and made dense, so that the density can be increased. Especially, when the heating resistor layer 15 is made dense, the electric resistance can be stabilized and an acceptable intensity of electric current can be increased. Therefore, the reliability and durability can be enhanced. Further, an energizing treatment for aging is performed, and then the process proceeds to an inspection.

Figure 4B:
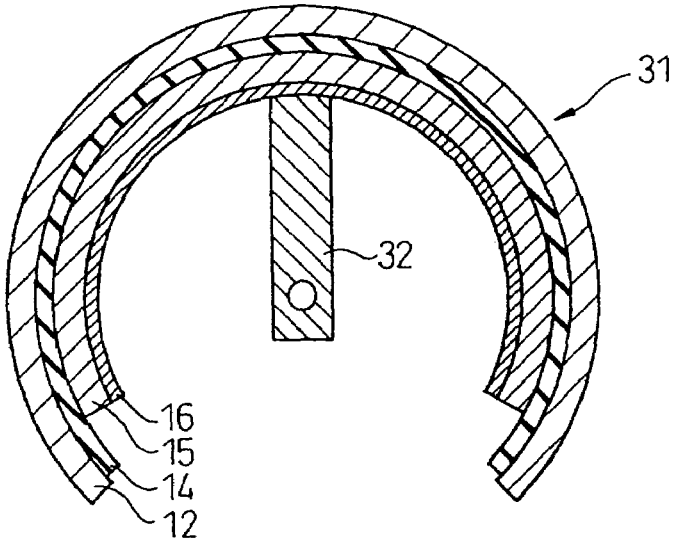
FIG. 4B is a cross-sectional view showing the heating member for fixation using the heat plate shown in FIG. 4A.
Figure 4C:
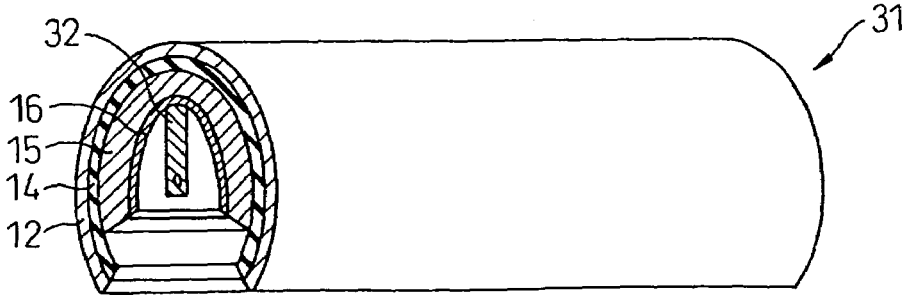
FIG. 4C is a perspective view showing the heating member shown in FIG. 4B.

FIG. 4B is a lateral sectional view of the semicircular heating member for fixation according to the first embodiment of the present invention, and FIG. 4C is a perspective view of the semicircular heating member. The semicircular heating member 31 shown is manufactured as follows. The heat plate 11, which has been manufactured as described above, is press-formed into a curved shape, so that the metallic base plate 12 can be formed into a convex. After the semicircular heating member 31 has been manufactured in this way, the external connecting conductive bodies 32 are attached to both end portions of the semicircular heating member 31.

Although not shown, this external connecting conductive body 32 is connected to the lead-in terminal 17, and electric power is supplied from the external connecting terminal 32.

Since a section of this semicircular heating member 31 is not a true circle, the semicircular heating member 31 is not rotated in its use, that is, the semicircular heating member 31 is stationarily arranged at a predetermined position at all times.

Figure 5:
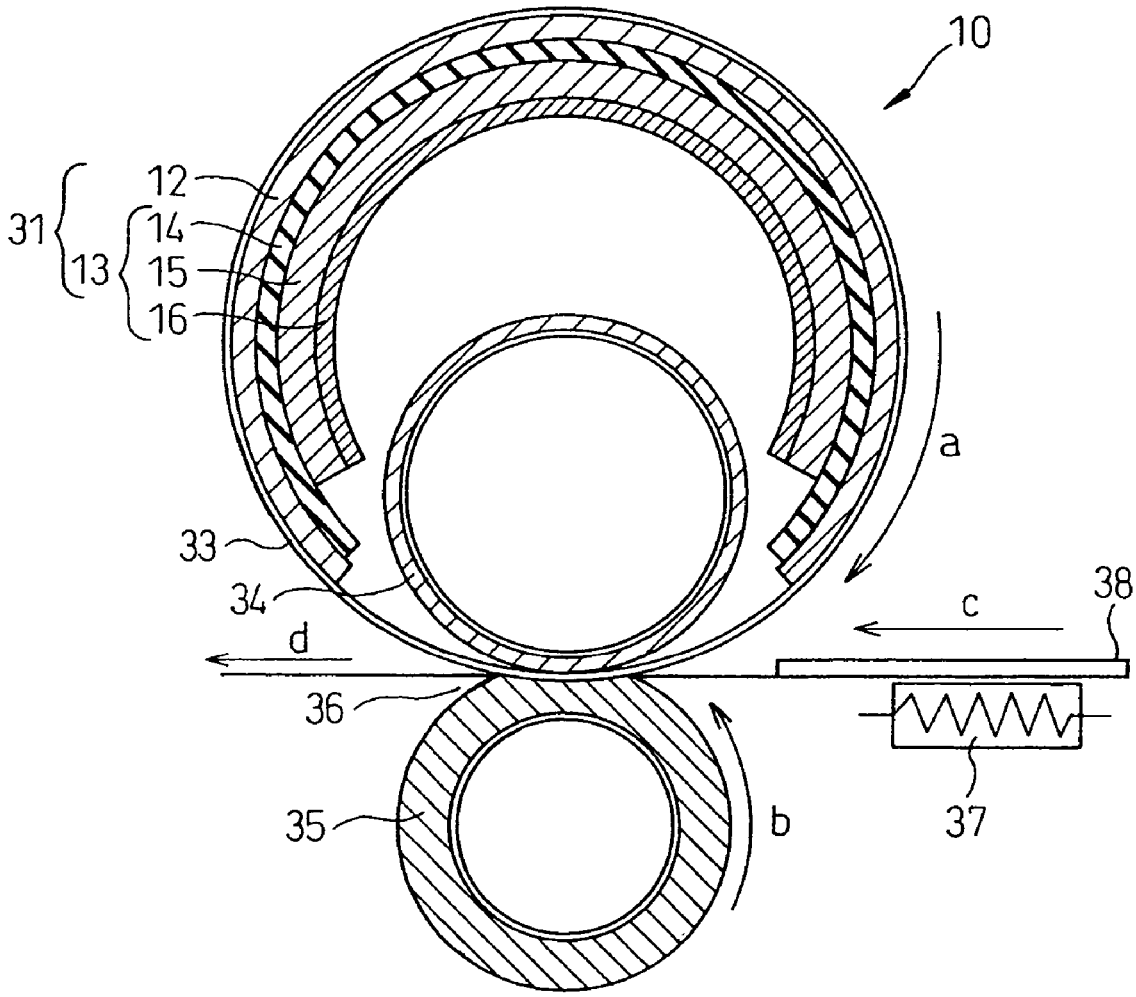
FIG. 5 is a cross-sectional view showing the fixing roller-circumscribing ultra small-sized belt type fixing device according to the present invention.

FIG. 5 is a sectional view of the external fixing roller type, ultra small and multifunctional belt type fixing device 10 in which the pressure roller 34 is incorporated into the above semicircular heating member 31 for fixation. In the belt type fixing device 10, the pressure roller 34 is arranged on the inner face of the semicircular heating member 31, and the endless belt 33 for fixation is wound round the outer circumference of the semicircular heating member 31. The fixing roller 35 is arranged in such a manner that the endless belt 33 for fixation is interposed between the pressure roller 34 and the fixing roller 35. The pressure roller 34 is pressed against the endless belt 33 for fixation from the upside, so that the endless belt 33 for fixation can be strained.

In the shown belt type fixing device 10, the endless belt 33 for fixation is rotated as the endless belt 33 comes into sliding contact with the convex of the semicircular heating member 31. Therefore, the pressure contact portion 36 of the pressure roller 34 with the endless belt 33 becomes a heating region. Then, the recording sheet 38, the reverse face of which has already been heated by the heat plate 37 for preliminary heating, is made to pass through this heating region, so that a toner image, not shown, can be thermally fixed. Since the toner attached to the recording sheet 38 has already been fused, thermal fixation can be easily executed, and the toner seldom becomes attached to the endless belt 33, and little heat is consumed by the endless belt 33. This multifunctional semicircular heating member 31 is of a stationary type. Therefore, this multifunctional semicircular heating member 31 is not rotated at all. Accordingly, a plurality of lead-in terminals 17 can be easily arranged in the semicircular heating member 31, which is advantageous in reducing the manufacturing cost.

When the pressure roller 34 is rotated in the direction of arrow "a" and the fixing roller 35 is rotated in the direction of arrow "b", the recording sheet 38, on which a toner image not fixed yet has already been transferred, is drawn in the direction of arrow "c". As the endless belt 33 for fixation comes into sliding contact with the semicircular heating member 31, the endless belt 33 is heated to a predetermined fixing temperature, and the toner image can be thermally fixed onto the recording sheet as it comes into contact with the endless belt 33 in the pressure contact portion 36. Since the toner image is thermally fixed as described above, the toner image becomes a fixed image, and the recording sheet 38 is discharged in the direction of arrow "d".

In order to make the recording sheet 38 run while the toner image is being fixed, the recording sheet 38 is contacted with the fixing roller 35 while the endless belt 33 is being strained by the pressure roller 34. The fixing roller 35 and the pressure roller 34 rotate the endless belt 33 in cooperation with each other, so that the endless belt 33 is positively made to come into sliding contact with the stationary convex of the semicircular heating member 31. Even if the endless belt 33 comes into sliding contact with the convex, the convex is not worn out because the convex is made of metal. Accordingly, the heating resistor 13 arranged inside is not worn out. As a result, the life of the multifunctional semicircular heating member 31 can be extended and its reliability ensured.

When the heating resistor layer 15 is energized and heated, the semicircular heating member 31 for fixation can be quickly heated. The thus generated heat is transmitted from the convex of the semicircular heating member 31 to the endless belt 33 for fixation, so that the endless belt 33 is heated to and held at a predetermined temperature. In this case, the endless belt 33 comes into sliding contact with the convex of the semicircular heating member 31, and the contact area is large. Therefore, heat transmission can be easily accomplished, and the temperature of the endless belt 33 easily raised.

The recording sheet 38 heated by the heat plate 37 for preliminary heating is inserted and pressed between the endless belt 33 for fixation and the fixing roller 35. In this case, a toner image face of the recording sheet 38 is directed to the endless belt 33. Accordingly, the preliminary heated toner image is positively fixed by the endless belt 33, the temperature of which is held at a predetermined temperature, and the transfer sheet 38, on which the toner image has been fixed, is discharged outside. When the toner image is thermally fixed in this way, a temperature difference is caused between a portion, in which the recording sheet has threaded, and a portion, in which the recording sheet has not threaded, on the endless belt 33. However, the problem of this temperature difference can be quickly solved by supplying heat from the convex of the semicircular heating member 31 for fixation, and the temperature can be returned to the predetermined value in a moment.

Figure 6:
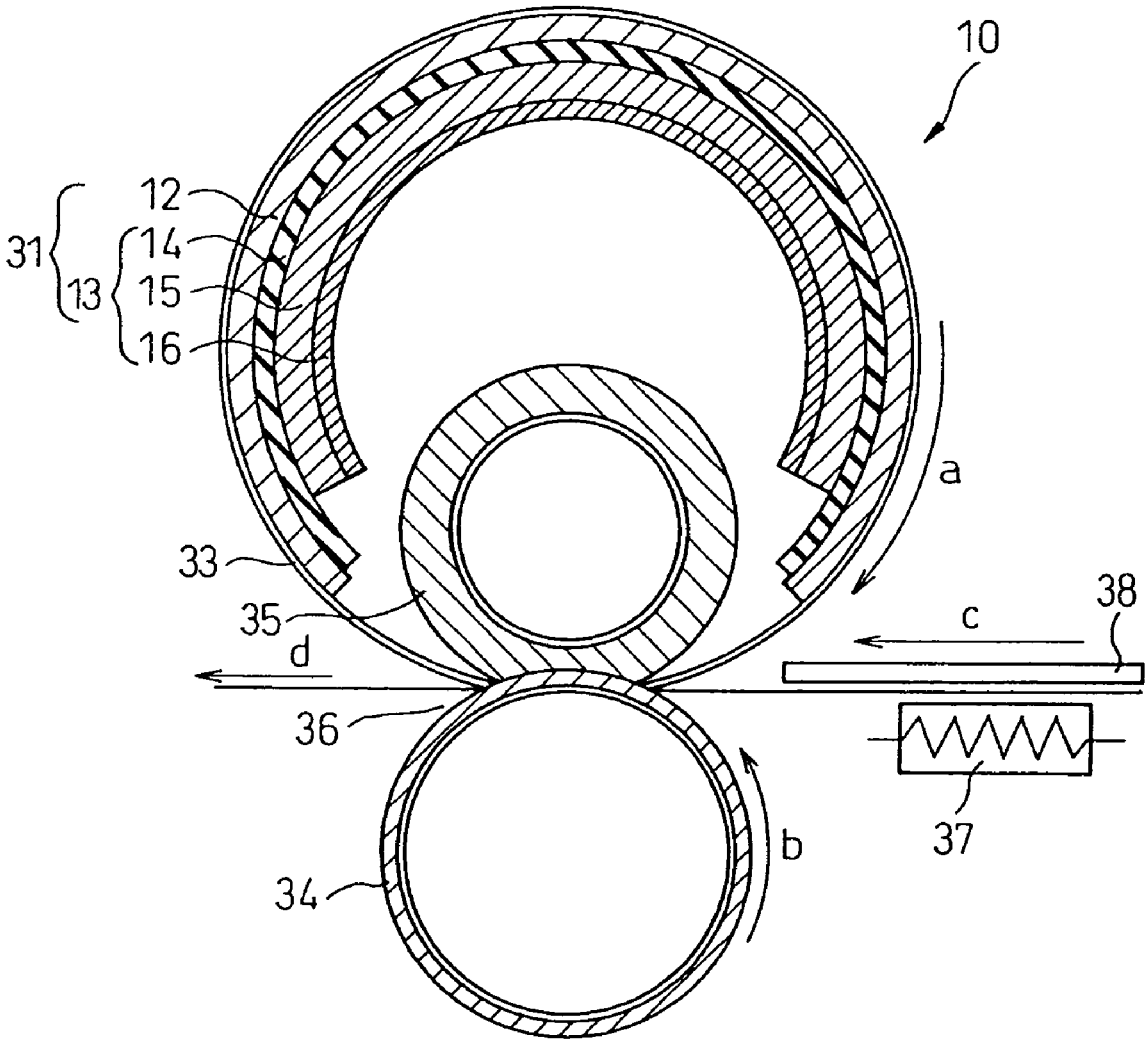
FIG. 6 is a cross-sectional view showing the fixing roller-inscribing ultra small-sized belt type fixing device according to the present invention.

Next, referring to FIG. 6, explanations will be made into an inner fixing roller type ultra small multifunctional belt type fixing device 10 in which the fixing roller 35 is incorporated into the semicircular heating member 31 for fixation of the first embodiment described above.

The belt type fixing device 10 shown in the drawing is composed as follows. The fixing roller 35 is arranged on the inner face of the semicircular heating member 31 for fixation, and the endless belt 33 for fixation is wound round an outer circumference of the semicircular heating member 31. The pressure roller 34 is arranged in such a manner that the endless belt 33 is interposed between the pressure roller 34 and the fixing roller 35. When the pressure roller 34 is pressed upward to the endless belt 33, the endless belt 33 can be strained. In this case, the pressure contact portion 36, in which the pressure roller 34 and the endless belt 33 come into pressure contact with each other, becomes a heating region. When the recording sheet 38, the reverse face of which has been heated by the heat plate 37 for preliminary heating, passes in this pressure contact portion 36, the toner image (not shown) formed on the recording sheet 38 is thermally fixed onto the recording sheet 38. At this moment, the toner attached onto the recording sheet 38 has already been fused. Therefore, thermal fixation can be easily executed, and the toner seldom adheres onto the endless belt 33 and the heat on little heat is consumed by the endless belt 33. Since the multifunctional semicircular heating member 31 for fixation is of a stationary type, it is not rotated. Therefore, a plurality of lead-in terminals can be easily attached to the semicircular heating member 31, thereby reducing the manufacturing cost.

Next, referring to FIG. 7, explanations will be made into a heat plate for fixation according to the second embodiment of the present invention. The heat plate for fixation is curved into a semicircle and incorporated into a fixing device in the same manner as that of the heat plate for fixation of the first embodiment explained before referring to FIG. 4A.

The heat plate 11 for fixation shown in FIG. 7 is different from that of the first embodiment described before at a point that the layer thickness is not constant. Accordingly, like reference characters are used to indicate like parts in the first and the second embodiment, and only different points will be explained below. Since the heat generated on the heating resistor layer 18 diffuses outside from the led-in terminal 17, the temperature of the heating resistor layer 18 on the lead-in terminal 17 side is decreased lower than the temperature in the central portion at all times. However, in order to maintain uniformity of thermal fixation on the recording sheet, it is preferable that the temperature distribution on the metallic base plate 12 be uniform without conducting temperature control. Accordingly, in order to increase the electric heating power of the heating resistor layer 18 on both the lead-in terminal 17 sides as compared with the heating electric power of the heating resistor layer 18 in the central portion, the layer thickness of the heating resistor layer 18 on the lead-in terminal sides is controlled to be less than the layer thickness of the central portion as shown in the drawing. Accordingly, the heating electric power on the lead-in terminal sides can be made higher than that of the central portion. As a result, the temperature can be made uniform all over the region on the metallic base plate 12, and the surface temperature distribution on the heat plate can be made uniform.

Next, referring to FIG. 8, explanations will be made into a heat reflection type heat plate for fixation according to the third embodiment of the present invention. The heat plate for fixation is curved into a semicircle and incorporated into a fixing device in the same manner as the first and the second embodiment. In this connection, the heat plate 11 for fixation shown in FIG. 8 is similar to the heat plate 11 for fixation shown in FIG. 7. Therefore, like reference characters are used to indicate like parts in FIGS. 7 and 8, and the same explanations will be omitted and only different points will be explained here.

In the heat plate 11 for fixation shown in the drawing, on the reverse face of the heating resistor layer 15, there is provided a heat insulation strengthening layer 21. Also, there is provided a heat reflecting layer 22 via the heat insulation strengthening layer 21. On the reverse face of this heat reflecting layer 22, there is provided a protective layer 16. In general, the electric insulating layer is made of heat insulating material in many cases and provided with a heat insulating action. However, it is impossible to provide a sufficiently high heat insulating action only by the electric insulating layer. Therefore, the heat insulation strengthening layer 21 is arranged between the heating resistance layer 15 and the heat reflecting layer 22, so that the heat insulation function can be enhanced in addition to the electric insulating function of the electric insulating layer.

In this case, when the heat insulation strengthening layer 21 is made of inexpensive heat insulating material, it is possible to reduce the manufacturing cost even if the thickness of the heat insulation strengthening layer 21 is increased. For example, the heat insulation strengthening layer 21 may be composed in such a manner that an heat insulation filler is uniformly mixed with liquid heat-resistant organic insulating material and coated. An example of the liquid heat-resistant organic insulating material is polyimide varnish, which can be used for this object. As the heat insulation filler, it is possible to utilize heat-resistant material, the heat conductivity of which is low. Examples of the heat insulating filler are glass, glass wool, various ceramics, refractories, sand, various oxides and various metallic oxides. These materials are made into powder and mixed with liquid heat-resistant organic insulating material so as to be formed into heat insulating materials.

On the reverse side of the heat insulation strengthening layer 21, there is provided a heat reflecting layer 22. On this heat reflecting layer 22, heat rays, which are directly irradiated from the temperature control type heating resistor layer 19 and diffused through the heat reflecting layer 22, are reflected onto the metallic base plate 12 side. Therefore, this heat reflecting layer 22 provides an effect of reducing the temperature rising time of the metallic base plate 12. In this case, a mirror surface may be used as a heat reflecting face. For example, a mirror surface side of a metallic film such as a sheet of aluminum foil may be arranged as a reflecting face. By this heat reflecting layer 22, it is possible to remarkably reduce the temperature rising time of the semicircular heating member 31 for fixation. Therefore, this heat reflecting layer 22 can contribute to improvements in the temperature rising characteristic and energy-saving.

Further, the electrode layer, which is a contact portion of the lead-in terminal 17 with an end portion of the heating resistor 13, is arranged so that it can come into contact with the sides of the heating resistor layer 15, heat insulation strengthening layer 21 and protective layer 16, however, both end portions of the heat reflecting layer 22 are electrically insulated by the protective layer 16. The structure and function of the protective layer 16 are the same as those of the first embodiment described before. Therefore, explanation thereof will be omitted here.

In this third embodiment, the heating resistor 13 has a laminar structure composed of a heat transmission strengthening layer 14, temperature control type heating resistor layer 19, heat transmission strengthening layer 20, heating resistor layer 15, heat insulation strengthening layer 21, heat reflecting layer 22 and protective layer 16 which are laminated. In the production of this heating resistor 13, the screen printing method can be most appropriately applied.

Especially, it is preferable that the temperature control type heating resistor layer 19 is made of resistor material, the temperature coefficient of which is positive. Concerning the resistor material, the temperature coefficient of which is positive, it is possible to use the primary resistor materials described before, and also it is possible to use a single metal such as Ge, Si or Zn or SnZn alloy or $Y_3FeO_{12}$ as auxiliary materials. Depending upon the characteristic of the positive temperature coefficient, when the temperature is raised, the resistance is increased and the heating electric power is decreased, so that the upper limit of the heating resistor layer can be controlled. That is, since the resistance is low in the initial heating stage of the temperature control type heating resistor layer 19, a high-intensity electric current flows and the temperature is quickly raised thereby. As the temperature is raised, the resistance is increased and the intensity of electric current is decreased, and the heating electric power is reduced. Therefore, the temperature of the temperature control type heating resistor layer 19 converges upon a predetermined temperature. In this way, the maximum temperature can be controlled and set automatically.

Next, referring to FIG. 9, explanations will be made into a self-temperature-control type heat plate for fixation according to the fourth embodiment of the present invention. The heat plate for fixation is curved into a semicircle and incorporated into a fixing device in the same manner as the first to the third embodiment described before. The heat plate 11 for fixation shown in FIG. 9 is similar to the heat plate 11 for fixation shown in FIGS. 7 and 8. Therefore, like reference characters are used to indicate like parts in FIGS. 7, 8 and 9, and the same explanations will be omitted and only different points will be explained here.

In the heat plate 11 for fixation shown in the drawing, on the reverse face of the metallic base plate 12, there are provided a heat transmission strengthening layer 14, temperature control type heating resistor layer 23, the temperature coefficient of which is negative, heat transmission strengthening layer 20, common heating resistor layer 18, heat insulation strengthening layer 21, heat reflecting layer 22 and protective layer 16 which are successively laminated. Further, on the heating resistor layer 18, there are provided a driving electrode layer (an extending portion of the lead-in terminal 17 in the vertical direction) and a lead-in terminal 17. On the temperature control type heating resistor layer 23, there are provided a driving electrode layer (an extending portion of the lead-in terminal 25 in the vertical direction) and a lead-in terminal 25. The lead-in terminal 17 is controlled by a common electric power source, and the lead-in terminal 25 is controlled by a constant electric current power source. Both the lead-in terminals are electrically insulated from each other by the electric insulating layer 24.

The heat plate 11 for fixation shown in the drawing is different from the heat plate of the third embodiment shown in FIG. 8 as follows. The point of difference resides in that a set of the heat transmission strengthening layer 14 and the temperature control type heating resistor layer 23 are put on a set of the heat transmission strengthening layer 20 and the heating resistor layer 18.

The temperature control type heating resistor layer 23 is made of resistor material, the temperature coefficient of which is negative, and connected to the constant electric current power source. As described before, the temperature control type heating resistor layer 23 quickly supplies heat to the sheet threading section when the temperature of the sheet threading portion is lowered, and further the temperature control type heating resistor layer 23 suppresses an increase in the temperature of the portion in which the recording sheet has not threaded yet. In this way, the temperature control type heating resistor layer 23 instantly solves the problems of a local temperature difference caused in the semicircular heating member for fixation.

The structure and action of the heat transmission strengthening layers 14 and 20 are the same as those of the heat transmission strengthening layers described before. Therefore, explanation thereof will be omitted here.

As shown in the drawing, in the fourth embodiment, the sections of the heating resistor layer 18 and the temperature control type heating resistor layer 23 are composed in such a manner that the layer thickness of the central portion is larger than that of the lead-in terminal portion. Due to the foregoing, the temperature distribution of the heating member can be maintained uniform.

Since the temperature coefficient of the temperature control type heating resistor layer 23 is negative, when the temperature of the heating resistor layer 18 is locally raised, the resistance is lowered and the heating electric power is reduced, so that the temperature of the heating resistor layer 18 is moved to a lower side. In contrast, when the temperature of the heating resistor layer 18 is decreased locally, the resistance is increased and the heating electric power is raised, so that the temperature of the heating resistor layer 18 is moved to a higher side. That is, the temperature control type heating resistor layer 23 can exhibit what is called a self-temperature-control property. However, it is necessary to provide a constant electric current power source in this case.

As a resistor material, the temperature coefficient of which is negative, composing the temperature control type heating resistor layer 23, there is provided a semiconductor material. The physical properties of a semiconductor material can be adjusted by adding impurities to the semiconductor material. It is possible to utilize a metal of Group IV of the periodic table to which a metal of Group III or V is added as impurities. Examples of metals of Group IV are Si and Ge. Examples of metals of Group III are Al, Ga and In. Examples of metals of Group V are As, Sb and Bi. As another semiconductor material, it is possible to use fine powder of a transition metal oxide, that is, a lower oxide of Ni or Ti, for example, $NiO_{2-x}$ or $TiO_{2-x}$ can be used. As a resistor material of the temperature control type heating resistor layer 23, it is possible to use a material the primary material of which is fine powder of Mo or Ag, and the auxiliary material of which is a material in which impurities of Group III or V on the periodic table are added to a metal of Group IV on the periodic table, or the auxiliary material of which is powder of transition metal oxide.

Next, referring to FIG. 10, explanations will be made of a complete self-temperature-control type heat plate for fixation according to the fifth embodiment of the present invention. The heat plate for fixation is curved into a semicircle and incorporated into a fixing device in the same manner as the first to the fourth embodiment. The heat plate 11 for fixation shown in FIG. 10 is similar to the heat plates 11 for fixation shown in FIGS. 7 to 9. Therefore, like reference characters are used to indicate like parts in FIGS. 7, 8, 9 and 10, and the same explanations will be omitted and only different points will be explained here.

In the heat plate 11 for fixation shown in the drawing, on the reverse face of the metallic base plate 12, there are provided a heat transmission strengthening layer 14, temperature control type heating resistor layer 23, the temperature coefficient of which is negative, heat transmission strengthening layer 20, temperature control type heating resistor layer 26, the temperature coefficient of which is positive, heat insulation strengthening layer 21, heat reflecting layer 22 and protective layer 16 which are successively laminated. The temperature control type heating resistor layer 26 is connected to a common electric power source via the lead-in terminal 27 and controlled by electric power supplied from the common electric power source. The temperature control type heating resistor layer 23 is connected to a constant electric current power source via the lead-in terminal 25 and controlled by electric power supplied from the constant electric current power source.

The temperature control type heating resistor layer 26 is in charge of controlling an upper limit of the temperature of the semicircular heating member 31. In the case of an accident such as a breakdown of the control circuit, this layer takes charge of regulating the upper limit of the temperature so as to automatically prevent the heating resistor and the recording sheet from burning. Therefore, this layer enhances the reliability of the multifunctional fixing system of the next generation of the present invention. Further, this layer contributes to a quick rise in the temperature.

As described above, the temperature control type heating resistor layer 23 makes the local surface temperature distribution of the semicircular heating member 31 uniform in a moment. The complete self-temperature-control type heat plate for fixation is a heating member which composes a principal portion of the multifunctional fixing system of the next generation.

The present invention also relates to an image forming apparatus based on an electrophotographic system such as an electrophotographic copier, electrophotographic facsimile, electrophotographic printer and electrostatic printing machine. These image forming apparatus are characterized in that the belt type fixing device of the present invention is arranged in the image fixing section.

The electrophotographic process, which is applied to the image forming apparatus of the present invention, will be explained below. The electrophotographic process can be a common electrophotographic process used in the field of image formation. Therefore, the electrophotographic process is not limited to a specific electrophotographic process. In the same manner, the developing method of the electrophotographic process used in the present invention is not limited to a specific method, that is, it is possible to adopt an arbitrary developing method according to the desire. Accordingly, it is possible to prepare and use a developing agent each time which is most appropriate for each developing method while satisfying the necessary conditions required for the execution of the present invention. Accordingly, the developing method capable of being adopted for the present invention includes both the two component developing system and the one component developing system which are widely used in this technical field.

According to the two component developing system, development is conducted in such a manner that toner particles and carrier particles such as iron powder or glass powder are made to come into contact with each other by frictional electrification so that the toner particles are attached to the carrier particles, and further these toner particles are guided to a latent image portion so as to develop the latent image. In this system, the toner particles and carrier particles are combined with each other and formed into a developing agent. Concerning the developing method, the magnetic brush developing method is used.

As a developing method in which the use of carrier is omitted in the two component developing system, the one component developing system is well known. Since carrier is not used in this system, it is not necessary to provide a mechanism for controlling the concentration of toner, and further it is not necessary to provide a mechanism for mixing and stirring toner. Accordingly, this system is advantageous in reducing the size of the image forming apparatus. In the one component developing system, in general, a toner layer is formed into a uniform thin film on a developing roller made of metal, and this toner layer is guided into a latent image portion so as to develop the latent image. Electrical charges can be given to the toner particles on the developing roller by means of frictional electrification or electrostatic induction. For example, in the one component developing method conducted according to frictional electrification, magnetic toner is used in the BMT system and the FEED system in which contact is made. However, in the touch-down system in which contact is also made, non-magnetic toner is used. In this connection, since the electrophotographic process and the developing method used in the electrophotographic process have been explained in a large number of publications, reference should be made to such publications for more details.

The composition of electrophotographic toner used in the practice of the present invention may be essentially the same as that of toner conventionally used in the electrophotographic process. That is, irrespective of the formation of a monochrome or color image, in general, toner comprises at least binder resin and a coloring agent. Depending upon a developing method adopted in the electrophotographic process, toner may be either magnetic toner or non-magnetic toner.

Electrophotographic toner is spherical fine powders obtained in such a manner that a coloring agent, electrical charge controlling agent and wax are dispersed in binder resin made of natural or synthetic high polymer and then the thus obtained dispersion high polymer is crushed and classified. In the case of the two component developing agent, after the completion of dispersion of a coloring agent into binder resin, the obtained fine powders of toner are usually mixed in carrier such as iron powder or ferrite powder so that the toner and carrier can be formed into a developing agent, and the thus obtained developing agent can be used for visualizing an electrostatic latent image.

Figure 11:
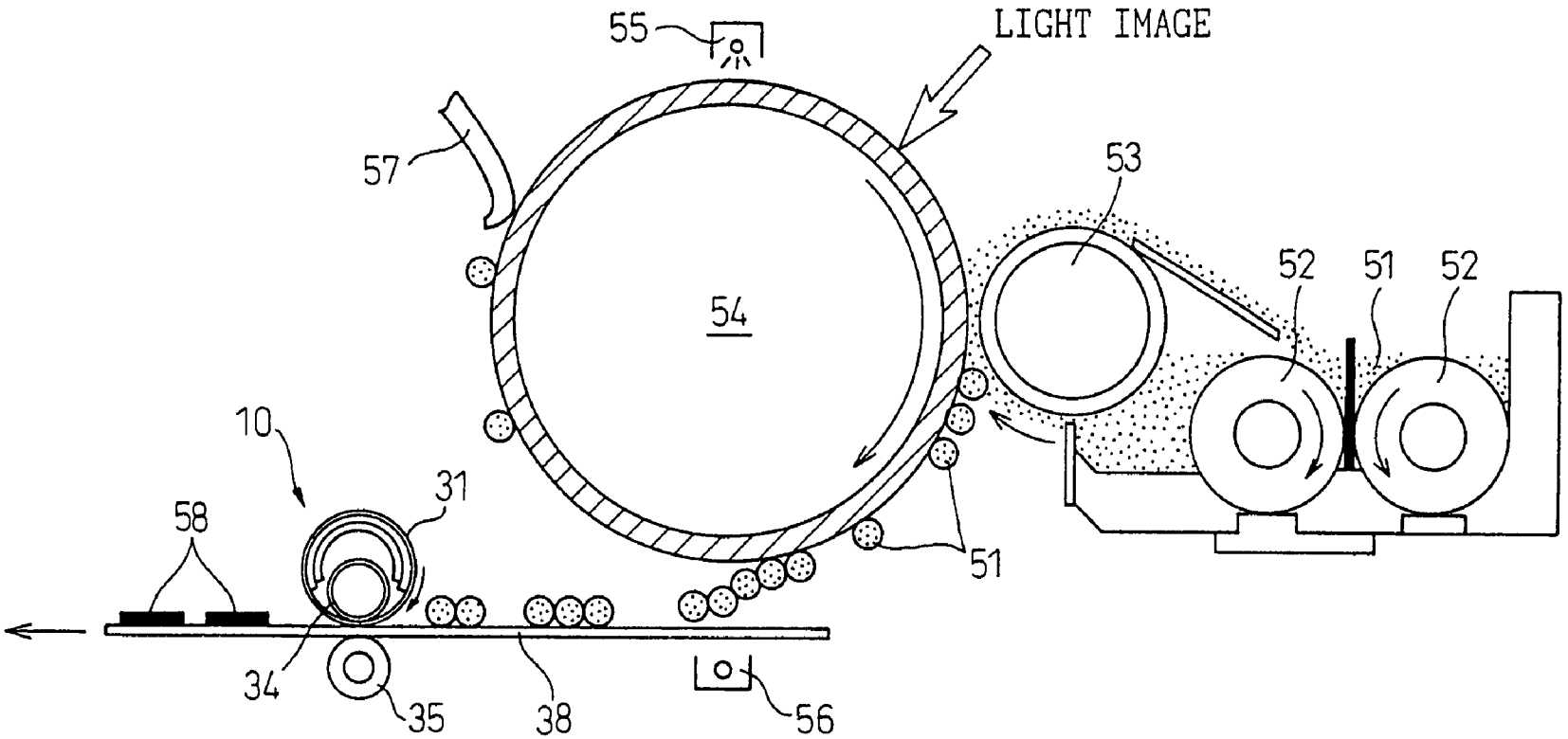
FIG. 11 is a schematic view showing an example of the electrophotographic apparatus according to the present invention.

FIG. 11 is a schematic view showing an example of the electrophotographic apparatus advantageously used in the practice of the present invention. The belt type fixing device of the present invention is incorporated into the image fixing section.

In the electrophotographic apparatus shown in the drawing, the developing agent 51, which has been prepared by mixing toner with carrier, is stirred by the stirring screw 52 so that the developing agent 51 can be frictionally electrified. The developing agent 51, which has been frictionally electrified, is guided in a predetermined circulating path and sent to the developing roller 53 arranged in the image developing section. Further, the developing agent 51 is conveyed to the photoreceptor drum 54 arranged in the electrostatic latent image forming section. Depending upon the latent image forming system, various photoreceptor drums 54 are provided. For example, the photoreceptor drum, which is made of a photoconductive material, may be composed of an organic photoreceptor such as polysilane or phthalocyanine. Alternatively, the photoreceptor drum may be composed of an inorganic photoreceptor such as selenium or amorphous silicon. Alternatively, the photoreceptor drum may be composed of an insulating body.

On a surface of the photoreceptor drum 54 to which the developing agent 51 is conveyed, electrical charging is conducted on the photoreceptor drum 54 by the pre-charging section 55 which is arranged at the rear with respect to the rotational direction of the photoreceptor drum. Further, an electrostatic latent image is formed on the surface of the photoreceptor drum 54 by an optical image (light image) formed in an image exposure device (not shown). The pre-charging section 55 may be composed of a corona discharge mechanism such as a corotron or scorotron. Also, the charging section 55 may be composed of a contact charging mechanism such as a brush type charging device. The exposure device may be composed of a light source in which various optical systems such as a laser beam optical system, LED optical system and liquid crystal shutter optical system can be used. Therefore, the frictionally electrified developing agent 51, which has been conveyed onto the photoreceptor drum 54, adheres onto the drum surface, so that the visualized toner image can be obtained.

The toner image 51 formed on the photoreceptor drum 54 is conveyed to the image transfer section 56 when the drum is rotated. In this image transfer section 56, the toner image 51 is transferred onto the recording medium 38 such as a recording sheet of paper or film. Concerning the transfer section 56, various arrangements can be adopted depending upon a force used for transfer of a toner image such as an electrostatic force, mechanical force and adhesive force. For example, when transfer of the toner image is conducted by an electrostatic force, it is possible to use a corona transfer device, roller transfer device and belt transfer device.

The recording medium 38 is guided in the direction of an arrow and arrives at the belt type fixing device 10 of the present invention. In the fixing device 10, the pressure roller 34 is arranged inside the semicircular heating member 41, and the endless belt for fixation is wound round an outer circumference of the semicircular heating member 31, and the fixing roller 35 is arranged in such a manner that the fixing roller 35 is opposed to the pressure roller 34 via the endless belt for fixation. While the recording medium 38 is passing through between the fixing roller 35 and the pressure roller 34, the toner image is thermally fixed. The toner image on the recording medium 38 is heated and fused and fixed while the toner image is penetrating into the recording medium 38. In this way, the fixed toner image 58 can be provided.

On the photoreceptor drum 54, toner remaining on the drum without taking part in the image transfer process is electrically discharged by an electrical discharger (not shown). Then, toner 51 is removed from the surface of the photoreceptor drum 54 by the cleaning device (blade in the shown case) 57. The cleaning device is not limited to the above blade. It is possible to compose the cleaning device of a magnetic brush cleaner, electrostatic brush cleaner or magnetic roller cleaner.

The present invention has been described above referring to different embodiments thereof. However, it should be noted that the present invention is not limited to these embodiments, and variations or modifications may be made by one skilled in the art without departing from the spirit and scope of the present invention.

What is claimed is:

1. A temperature controlling type heat plate for fixation comprising: a metallic base plate; and a heating resistor arranged on a reverse face of the metallic base plate, the heating resistor being formed by laminating, at least, a heat transmission strengthening layer, a first heating resistor layer for controlling temperature, a first heat transmission strenghtening layer a second heating resistor layer, a second heat insulation strengthening layer, a heat reflecting layer and a protective layer in this order on the metallic base plate, wherein the first heating resistor layer for controlling temperature is made of a resistor material having a positive temperature coefficient, and when the heating resistor is energized and heated, the temperature of the heating resistor is automatically set and controlled so that the temperature is not increased to 300° C. or more.

2. A temperature controlling type heat plate for fixation according to claim 1, wherein the first heating resistor layer for controlling temperature having a positive temperature coefficient is made of ultra fine powders of Mo or Ag as a primary resistor material, and at least one of the single metals of Ge, Si, Sn and Zn, SnZn alloy, or $Y_3FeO_{12}$, as an auxiliary resistor material.

* * * * *